US005547356A

United States Patent [19]

Stehr et al.

[11] Patent Number: 5,547,356

[45] Date of Patent: Aug. 20, 1996

[54] GEAR PUMP AND METHOD OF USING SAME

[75] Inventors: Roger Stehr, Bülach; Peter Blume, Zürich; Marco Benetti, Villmergen, all of Switzerland

[73] Assignee: Maag Pump Systems AG, Zurich, Switzerland

[21] Appl. No.: 417,853

[22] Filed: Apr. 7, 1995

[30] Foreign Application Priority Data

Apr. 7, 1994 [EP] European Pat. Off. ..... 94105347

[51] Int. Cl.[6] ..... F01C 21/00

[52] U.S. Cl. ..... 418/189; 418/1; 418/102; 418/206.1

[58] Field of Search ..... 418/189, 206.1, 418/206.8, 102, 1

[56] References Cited

U.S. PATENT DOCUMENTS

| | | | |
|---|---|---|---|
| 3,113,524 | 12/1963 | Fulton | 418/189 |
| 3,303,792 | 2/1967 | Littlewood . | |
| 4,017,224 | 4/1977 | Jöns | 418/189 |
| 4,737,087 | 4/1988 | Hertell | 418/102 |
| 5,190,450 | 3/1993 | Ghosh et al. | 418/102 |

FOREIGN PATENT DOCUMENTS

| | | |
|---|---|---|
| 0189670 | 8/1986 | European Pat. Off. . |
| 0455059A1 | 11/1991 | European Pat. Off. . |
| 0559582A1 | 9/1993 | European Pat. Off. . |
| 94105347 | 9/1994 | European Pat. Off. . |
| 366152 | 4/1923 | Germany . |
| 8500273 | 1/1985 | United Kingdom . |

*Primary Examiner*—Charles G. Freay
*Attorney, Agent, or Firm*—Evenson McKeown Edwards & Lenahan, PLLC

[57] ABSTRACT

To reduce squeeze pressure peaks on meshing rotors of a gear pump, recesses are molded into the product duct wall in the meshing area, on the delivery side and the suction side. The recesses are formed with spherical segments or other continuously curved surfaces.

16 Claims, 2 Drawing Sheets

GEAR PUMP AND METHOD OF USING SAME

BACKGROUND

The present invention relates to a gear pump and method of using same, which gear pump has at least two rotors which mesh in an externally toothed manner in a product duct.

In the case of gear pumps with externally toothed, closely meshing shafts, considerable local pressure peaks occur during the squeeze-out operation to the pressure side caused by the entering of a tooth of the driven shaft into the corresponding tooth space on the non-driven shaft. During the delivery of higher viscous media, such as polymer meltings, these squeeze pressures reach peak values of several 100 bar. This extreme pressure rise, although it is short, results in considerable thermal stress and shearing stress to the delivered medium.

BRIEF DESCRIPTION OF THE PRIOR ART

With respect to the construction of the product duct of a gear pump for delivering also media which are sensitive to shear and/or heat, reference can be made, for example, to British Patent Document GB-A-85 00 273 and to European Patent Document EP-A-0 189 670 (U.S. Pat. No. 4,725,211). However, also in the case of such known pumps, the above-mentioned squeeze pressure peaks have the result that they cannot be used without reservations for the delivery of the above-mentioned media which are sensitive to shear and/or heat.

With respect to the possibility of at least reducing the above-mentioned squeeze pressure peaks, reference is made to European Patent Document EP-A-0 559 582 (U.S. Pat. No. 5,190,450), in which a volume-enlarging relief recess is provided on the delivery side of the product duct.

A gear pump of the initially mentioned type is known from European Patent Document EP-0 455 059 and German Patent Document DE-366 152. On the delivery and suction side, volume-enlarging recesses are molded into the product duct wall in the meshing area of the rotors by means of which the resulting pressure peaks are reduced. In this case, it is a disadvantage that, viewed in a cross-sectional plane in parallel to the plane which connects the rotor axes, the recesses have bent profiles. This has the result that the material to be conveyed accumulates in the recesses. The accumulations, which are subjected there to long-term thermal stress, may become detached in an uncontrolled manner and contaminate the conveyed material and are also difficult to access when the pump is cleaned.

SUMMARY OF THE INVENTION

It is an object of the invention to eliminate the disadvantages on a pump of the above-noted type.

This object is achieved according to preferred embodiments of the present invention by providing at least one volume enlarging recess in the product duct wall, which recess is formed with a continuously curved surface.

Certain preferred embodiments of the gear pump according to the invention include one recess respectively provided on both sides of the product duct in the direction of a plane connecting the rotor axis.

In certain preferred embodiments, at least one recess respectively is provided on the delivery and suction side of the area of the meshing of the rotors.

In certain preferred embodiments the at least one recess is formed as a spherical surface segment.

In certain preferred embodiments the rotors are disposed in product lubricated slide bearings and is/are molded at least partially into the face of a slide bearing body forming a part of the product duct wall.

In preferred methods of using the gear pump, very sensitive and/or heat sensitive media is pumped. In especially preferred methods, food or polymer meltings, such as PVC, caoutchouc or biopolymers is pumped.

Other objects, advantages and novel features of the present invention will become apparent from the following detailed description of the invention when considered in conjunction with the accompanying drawings.

DETAILED DESCRIPTION OF THE DRAWINGS

Figure 1:
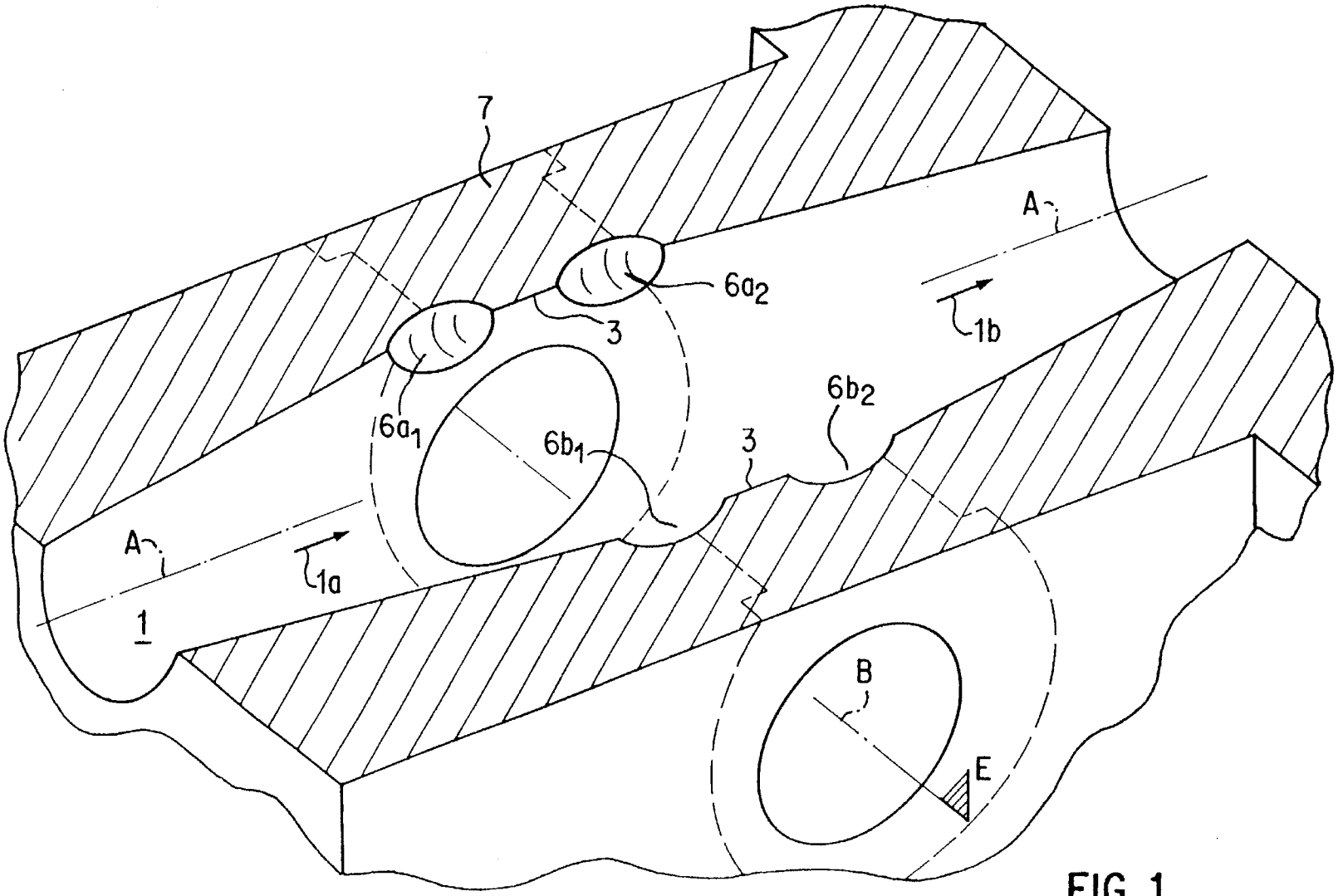
FIG. 1 is a perspective sectional view of a portion of a gear pump according to the invention, the sectional plane being located in the axis of the product duct and in parallel to the axes of the rotors.
Figure 2:
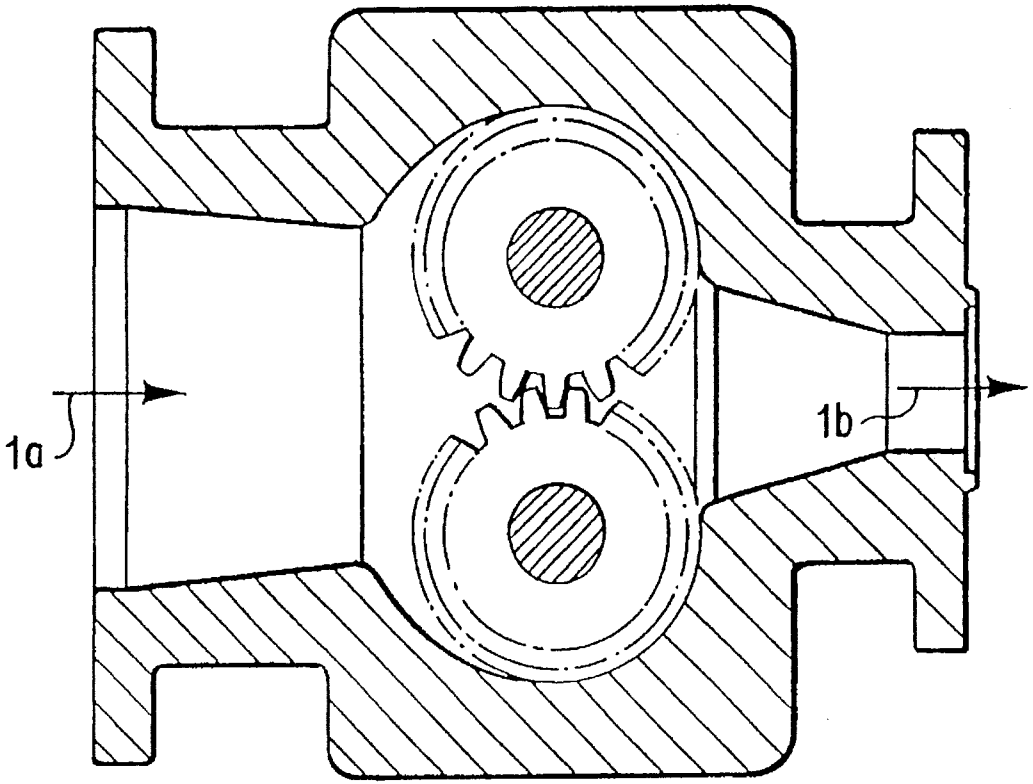
FIG. 2 is a schematic view of the gear pump of FIG. 1.

Drawing FIG. 1 is a sectional view of the product duct 1, along its axis A and in parallel to the axis B of one of the two provided rotors which are not shown in this FIG. 2 and mesh in an externally toothed manner. FIG. 2 schematically depicts the gear pump and rotor. The meshing area of the rotors is situated essentially in the sectional plane E of the selected representation. Furthermore, it is symmetrical with respect to a plane through the axis B and the axis, which is not shown here, of the second rotor which is situated above it in the selected representation.

According to the invention, one volume-enlarging recess $\mathbf{6}a_1$, $\mathbf{6}b_1$, respectively is molded into the product duct wall 3 on the inlet side, as shown to face the inlet duct portion 1*a*. Also on the outlet side, that is, facing the outlet duct portion 1*b*, volume enlarging recesses $\mathbf{6}a_2$, $\mathbf{6}b_2$ are molded into the product duct wall 3 of the product duct 1, these recesses being situated opposite one another on both sides of the location where the rotors mesh in the product duct 1.

As a result, it is permitted that, in the whole meshing area, when the teeth/tooth spaces approach and when they move away, the conveyed medium can be relieved from pressure into the provided recesses 6 ($\mathbf{6}a_1$, $\mathbf{6}a_2$, $\mathbf{6}b$, $\mathbf{6}b_2$), which prevents the formation of high squeeze pressure peaks and achieves, on the duct inlet side, an improvement of the filling behavior of the tooth spaces.

The recesses 6*a, b* are arranged in pairs symmetrically with respect to the plane $E_B$ which extends through the two axes B of the rotor shafts.

If, as is usually the case in preferred embodiments, the rotor shafts are slidably disposed by being lubricated by the conveyed medium, bearing bodies 7 are provided in the pump housing as indicated by a broken line with respect to one bearing journal. Depending on their dimension, the recesses 6 according to the invention are then constructed as continuously changing from the wall area of the product duct defined by the pump housing into the wall area of the mentioned duct defined by the face of the bearing body 7.

Naturally, the recesses provided according to especially preferred embodiments of the invention extend in an exactly identical manner in the upper, cut-away half of the product duct.

It should be noted that, particularly during the conveying of media which are sensitive to shear and/or heat, absolutely no dead corners or edges should be provided in the product duct. Otherwise, accumulations of the conveyed medium will occur and, as a result, corresponding damage to the conveyed medium.

According to preferred embodiment of the invention, the recesses $6a_1$ and $6a_2$, $6b_1$ and $6b_2$ are worked in (molded or formed into the product duct wall) such that they each have the shape of a spherical segment. When the pump is assembled, the recesses, each in pairs, define calotte shells or, more generally, continuously curved spatial surfaces. This ensures that no clearance spaces are created by means of the recesses provided according to the invention.

Deviations may take place from ideal ellipsoid or spherical-segment-shaped recesses and basically recesses may be provided which have continuously curved recess surfaces according to other contemplated preferred embodiments of the invention.

Even when, on the delivery side, only one such recess corresponding to $6a_2$ is provided according to other contemplated preferred embodiments, the pump behavior is significantly improved with respect to the requirement of having no clearance spaces.

A gear pump according to the invention is excellently suitable for the delivery of media which are sensitive to shear and/or heat, particularly polymer meltings, such as PVC, caoutchouc or biopolymers. However, it is also suitable for the conveying of food where, with respect to the absence of clearance spaces, the requirements are similar to those of the above-mentioned meltings.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Gear pump comprising at least two rotors which mesh in an externally toothed manner in a product duct, at least one volume-enlarging recess being molded in a product wall of said product duct at least on a delivery side of an area of meshing of the rotors, wherein the at least one recess is formed by a three dimensionally continuously curved surface.

2. Gear pump according to claim 1, wherein said product duct has a center line extending in use along a product conveying path, wherein a plurality of said recesses are provided, and wherein one recess respectively is provided on both lateral sides of the product duct center line.

3. Gear pump according to claim 1, wherein a plurality of said recesses are provided, and wherein at least one recess respectively is provided on the delivery and a suction side of the area of meshing.

4. Gear pump according to claim 2, wherein at least one recess respectively is provided on the delivery and a suction side of the area of meshing.

5. Gear pump according to claim 1, wherein the at least one recess is formed by a spherical surface.

6. Gear pump according to claim 2, wherein each of said recesses are formed by spherical segment surfaces.

7. Gear pump according to claim 3, wherein each of said recesses are formed by spherical segment surfaces.

8. Gear pump according to claim 4, wherein each of said recesses are formed by spherical segment surfaces.

9. Gear pump according to claim 1, wherein the rotors are disposed in product-lubricated slide bearings, and wherein the at least one recess is molded at least partially into the face of a slide bearing body forming a part of the product duct wall.

10. Gear pump according to claim 9, wherein said product duct has a center line extending in use along a product conveying path, wherein a plurality of said recesses are provided, and wherein one recess respectively is provided on both lateral sides of the product duct center line.

11. Gear pump according to claim 9, wherein a plurality of said recesses are provided, and wherein at least one recess respectively is provided on the delivery and a suction side of the area of meshing.

12. Gear pump according to claim 9, wherein at least one recess respectively is provided on the delivery and a suction side of the area of meshing.

13. Gear pump according to claim 10, wherein each of said recesses are formed by spherical segment surfaces.

14. A method for pumping very sensitive media by means of a gear pump, comprising at least two toothed rotors meshing in a meshing area, said toothed rotors extending between two wall surfaces of a pumping chamber, comprising the step of providing a recess in at least one of said wall surfaces adjacent said meshing area, each of said at least one recess being formed by a three-dimensional steadily curved recess surface.

15. The method according to claim 14, comprising the step of pumping heat sensitive media.

16. The method according to claim 14, comprising the step of pumping of food, polymer melting, PVC, caoutchouc, and biopolymers.

* * * * *